US005120410A

United States Patent [19]

Herdzina, Jr.

[11] Patent Number: 5,120,410

[45] Date of Patent: Jun. 9, 1992

[54] ROTARY ELECTROCOATING MACHINE

[75] Inventor: Frank J. Herdzina, Jr., Schaumburg, Ill.

[73] Assignee: Service Tool Die & Mfg. Company, Elk Grove Village, Ill.

[21] Appl. No.: 583,442

[22] Filed: Sep. 17, 1990

[51] Int. Cl.[5] ..... B65G 29/00; C25D 17/00; C25D 17/02; C25D 17/06

[52] U.S. Cl. ..... 204/299 EC; 204/300 EC; 204/180.2; 204/199; 118/409; 118/412; 118/426; 134/66; 134/79

[58] Field of Search ..... 204/299 EC, 300 EC, 204/180.2, 199, 201, 212; 118/409, 412, 423, 426; 134/66, 69, 79

[56] References Cited

U.S. PATENT DOCUMENTS

| | | | |
|---|---|---|---|
| 2,301,293 | 11/1942 | Kronquest | 118/426 |
| 2,355,249 | 8/1944 | Szabo, Jr. | 134/66 |
| 3,735,894 | 5/1973 | Kinkel | 220/54 |
| 3,759,810 | 9/1973 | Landauer et al. | 204/299 EC |
| 3,830,716 | 8/1974 | Haney et al. | 204/299 EC |
| 3,861,409 | 1/1975 | Taniguchi | 134/79 |
| 4,005,000 | 1/1977 | Kraska | 204/299 EC |
| 4,081,344 | 3/1978 | Shindou et al. | 204/299 EC |
| 4,908,153 | 3/1990 | Kossmann et al. | 204/299 EC |

*Primary Examiner*—John Niebling
*Assistant Examiner*—David G. Ryser
*Attorney, Agent, or Firm*—Kinzer, Plyer, Dorn, McEachran & Jambor

[57] ABSTRACT

An electrocoating machine for easy-open can ends has an electrocoating wheel rotatable about a horizontal axis and partially submersed in a bath of electrocoating solution. The electrocoating wheel carries ends into and through the bath. A transfer turret and elevator convey coated ends from the electrocoating wheel to a rinse wheel. The rinse wheel surrounds the electrocoating wheel and is mounted for rotation about a vertical axis. The rinse wheel is disposed in a tub which contains a plurality of nozzles for spraying rinse solution on the ends carried by the rinse wheel.

23 Claims, 3 Drawing Sheets

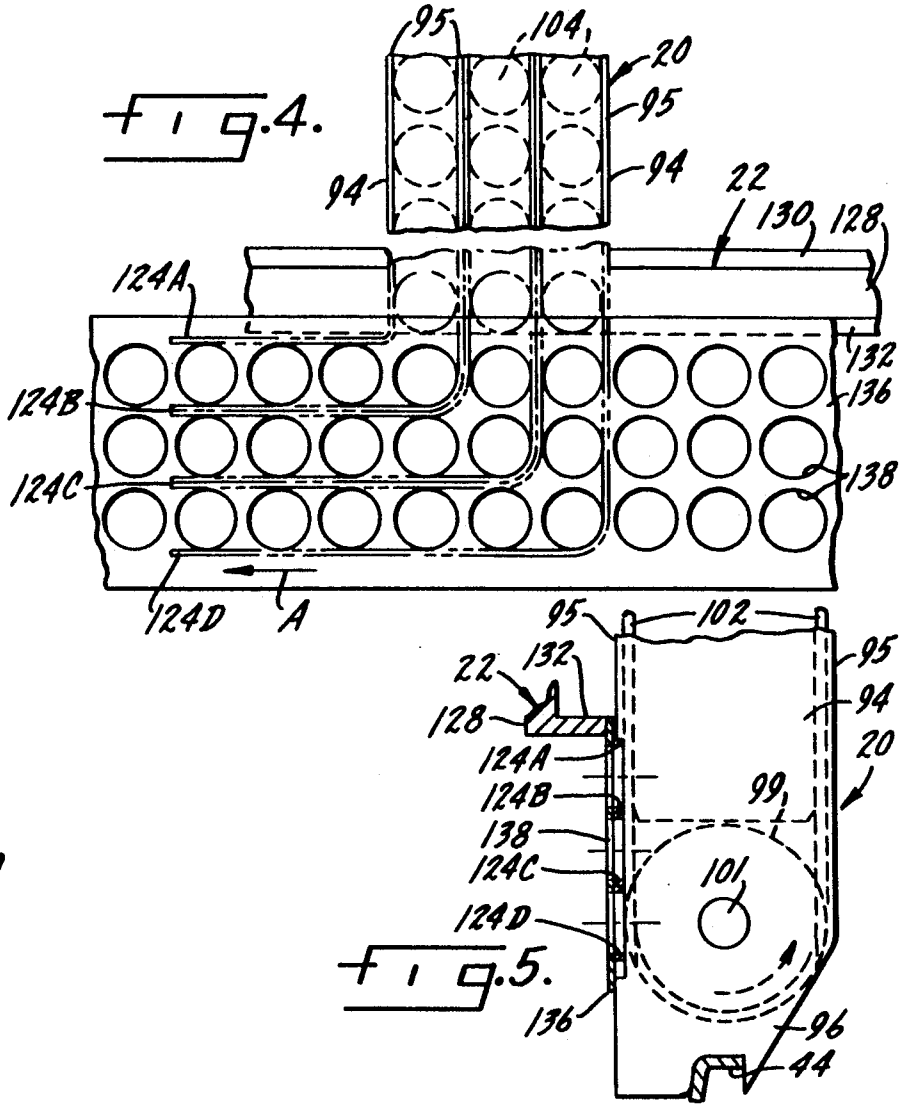
FIG. 4.
FIG. 5.
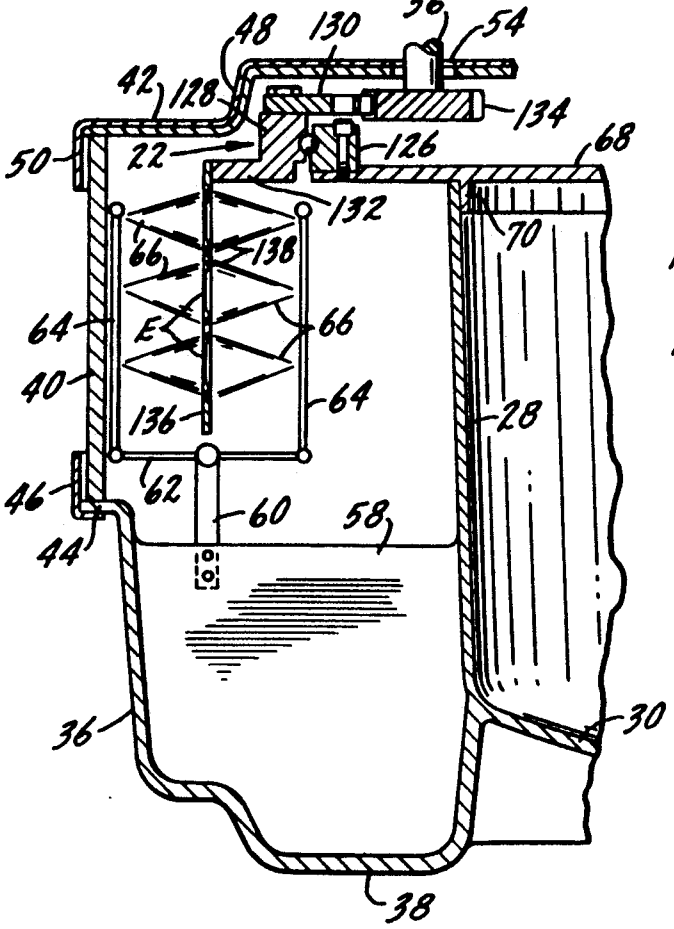
FIG. 3.

ROTARY ELECTROCOATING MACHINE

BACKGROUND OF THE INVENTION

This invention relates to electrocoating machines and is particularly concerned with machines for applying a repair coat to easy-open can ends. It is well known that ends for use with food and beverage cans, pet food cans and the like must be coated to protect the ends from environmental product attack. The sheet material from which can ends are made is supplied to the can fabricator with an appropriate organic resinous coating. However, formation of the end and attachment of the easy-open tab may expose raw, uncoated edges and other discontinuities in the coating, such as scratches and score lines. Consequently, the finished ends are given a repair coat to ensure complete coverage of the coating. An electrocoater of this general character is shown in Kossman, U.S. Pat. No. 4,908,153, the disclosure of which is incorporated by reference herein. The present invention furthers the development of the Kossman electrocoater by increasing the number of lanes of ends passing through the machine and enhancing floor space utilization.

SUMMARY OF THE INVENTION

This invention relates to improvements in electrocoating machines for applying a repair coat to articles such as easy-open can ends. One of the objects of the invention is an electrocoating machine which increases production over known machines by providing more lanes for carrying ends through the machine. Another object of the invention is a machine of the type described having a substantially reduced footprint. The floor space required for the machine is reduced by wrapping the rinse conveyor around the electrocoating bath.

These and other objects are achieved by an electrocoating machine having a tank which includes a central first tub and a ring-shaped second tub surrounding the first tub. The first tub contains a bath of electrocoating solution and the second tub defines a plurality of rinse stations.

An electrocoating wheel is mounted for rotation about a horizontal axis with a portion of the wheel submersed in the bath in the first tub. The wheel has a plurality of rows of spaced, flexible fingers mounted thereon. Each row of fingers extends across the width of the wheel. Each individual finger is cantilevered in a radial direction beyond the circumference of the wheel to define a free end of the finger. All free ends are deflectable in a direction parallel to the axis of the wheel. The fingers are arranged in pairs with at least two pairs in each row. The finger pairs are engageable with a can end in spring-loaded gripping relation to carry ends through the electrocoating bath.

A rinse wheel is mounted for rotation about a vertical axis. The rinse wheel surrounds the electrocoating wheel and has a carrier portion disposed in the second-tub The rinse wheel's carrier has holding pockets for releasably securing can ends to the rinse wheel while carrying coated ends through the rinse stations.

A transfer turret and transfer elevator remove coated ends from the electrocoating wheel and place them on the rinse wheel. A drive motor is provided for driving the electrocoating wheel, rinse wheel, transfer turret and transfer elevator.

BRIEF DESCRIPTION OF THE DRAWINGS

FIG. 3 is an enlarged section through the rinse wheel and second tub.

FIG. 4 is an end elevation view showing the intersection of the transfer elevator and rinse wheel.

FIG. 5 is a side elevation view of the transfer elevator, looking from the left side of FIG. 4.

DETAILED DESCRIPTION OF THE INVENTION

Figure 1:
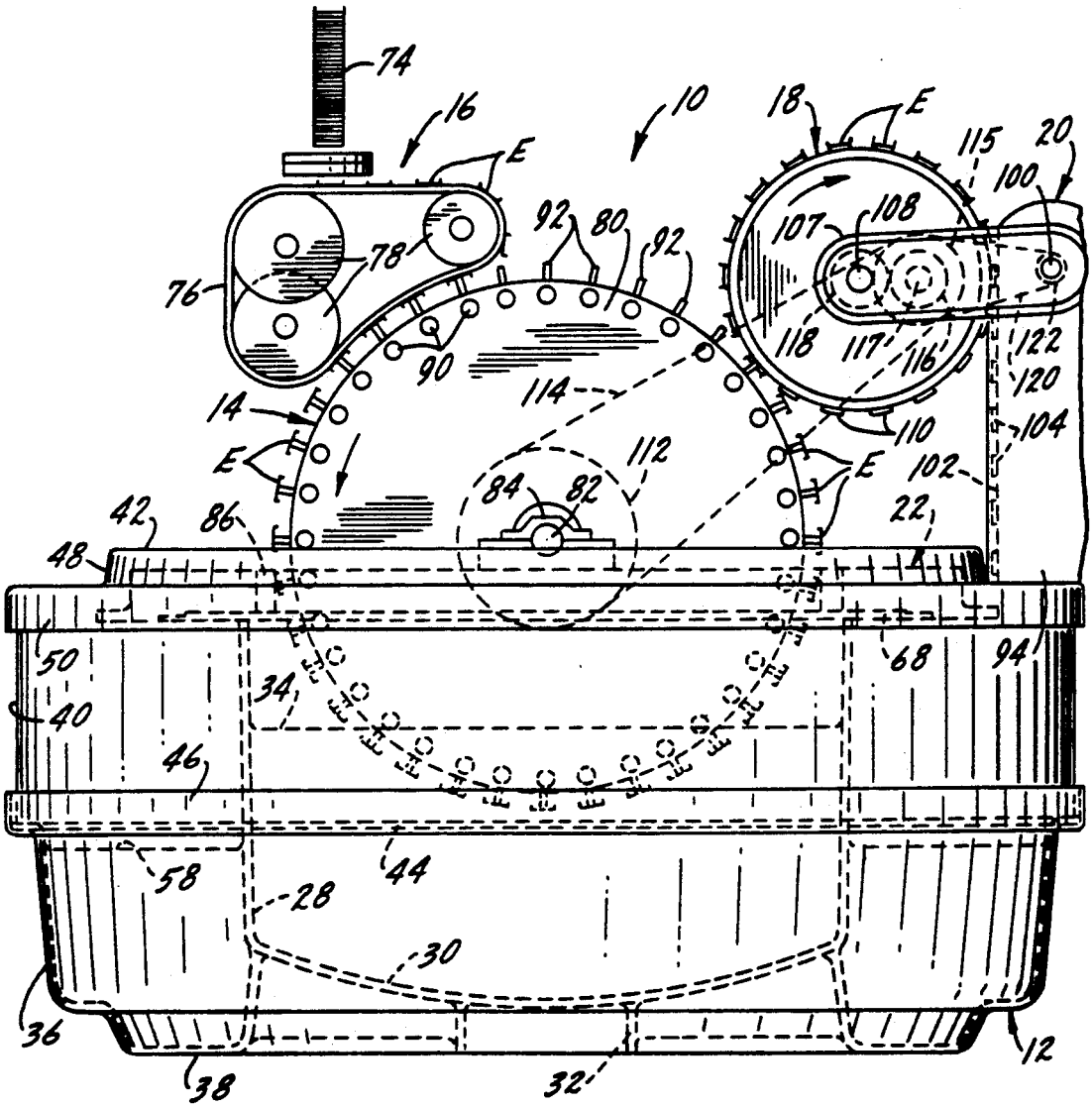
FIG. 1 is an elevation view of the electrocoating machine of the present invention.

The basic components of the electrocoating machine will be set forth generally at the outset to impart an overall sense of the machine. These components will then be described in detail below. The rotary electrocoater is shown at generally at 10 in FIGS. 1 and 2. The machine includes a tank 12 on which an electrocoating wheel 14 is mounted. The electrocoating wheel will sometimes be referred to herein as the e-wheel. The e-wheel 14 receives easy-open can ends E from an infeed mechanism 16. The e-wheel carries the ends through an electrocoating bath in tank 12. A transfer turret 18 takes ends E off the e-wheel 14 and carries them to a transfer elevator 20. The transfer elevator 20 lowers the ends to a rinse wheel, a portion of which is indicated at 22 in FIGS. 1 and 2. The rinse wheel is a ring-shaped wheel having an annular carrier rotatable about a vertical axis. A discharge turret 24 (FIG. 2) pulls coated, rinsed ends off the rinse wheel and places them on a discharge conveyor shown schematically at 26. The discharge conveyor takes the finished ends to an oven.

Turning now to the detailed description of the electrocoater components, the tank 12 comprises at least two separate containers, referred to herein as a first tub and a second tub. The first tub is defined by an inner side wall 28 which is integrally connected to a first bottom wall 30. The bottom wall may have reinforcements 32 underneath it to help support the weight of a bath of electrocoating solution in the first tub. The bath is indicated at 34 in FIG. 1. The lower portion of the electrocoating wheel 14 is submersed in the bath.

The second tub is defined by an outer wall 36, a second bottom wall 38, a cylindrical splash guard 40 and a splash cover 42. As seen in FIGS. 1 and 3, the inside edge of the second bottom wall curves upwardly to join the inner wall 28 and first bottom wall 30 near their intersection. Together the outer wall 36 and bottom wall 38 define a catch basin. The tank walls are made of fiberglass or other suitable material.

The outer wall 36 terminates at a radial lip 44. The splash guard 40 rests on the lip with a hoop 46 securing the joint. The splash cover 42 is tapered at 48 and has a flange 50 engaging the splash guard 40. Cover 42 also has a large central opening 52 (FIG. 2) which accommodates the e-wheel 14. The cover has a depending wall (not shown) around the periphery of the opening and extending downwardly to a mounting plate 68 which is described below. A hole 54 is provided in the splash cover 42 for the rinse wheel drive shaft 56.

Figure 2:
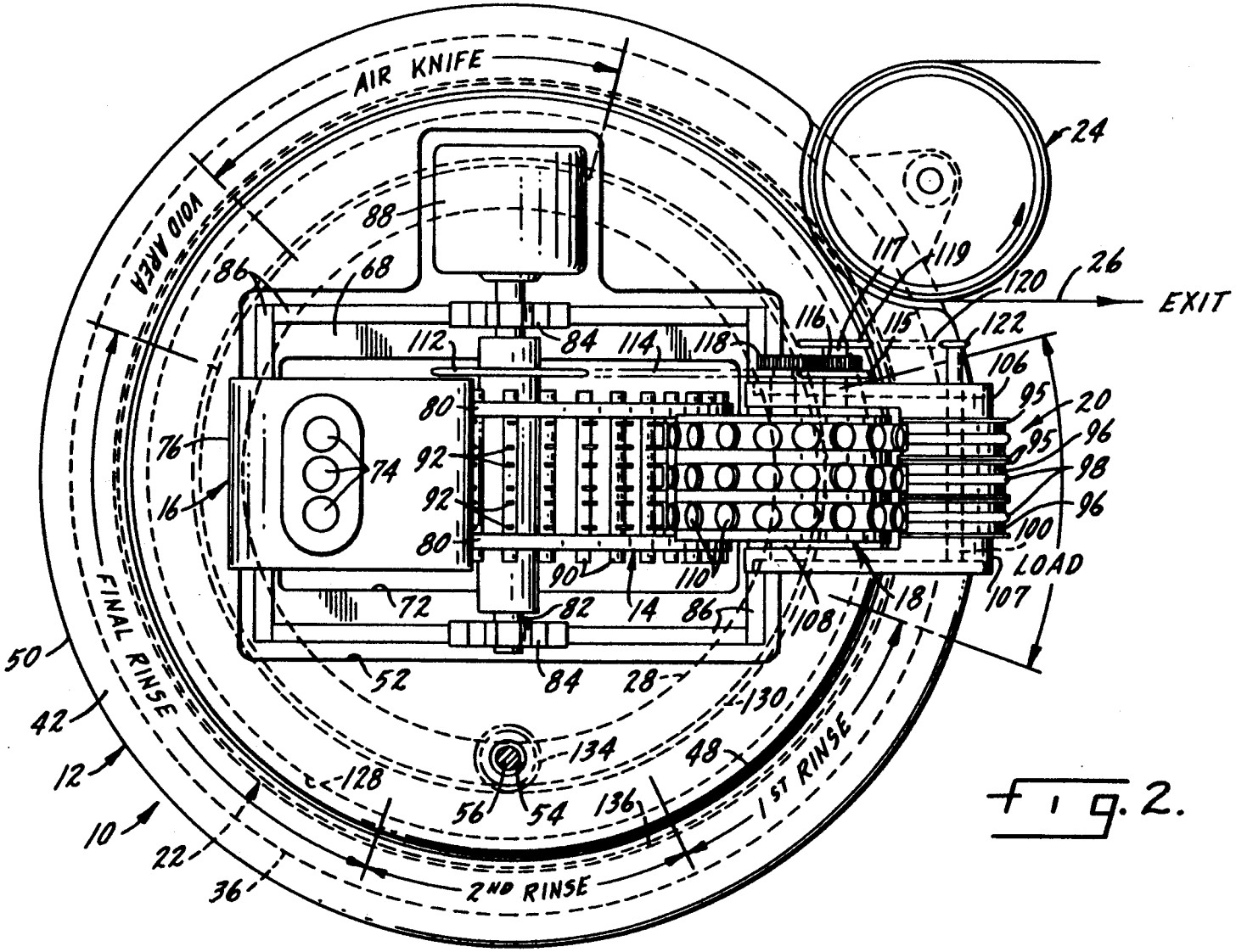
FIG. 2 is a plan view of the machine of FIG. 1.

As best seen in FIG. 3, one or more radial ribs 58 connect the inner and outer side walls 28 and 36. The ribs mount a plurality of brackets 60 which in turn support the necessary plumbing 62 for a plurality of spray nozzles 64. The nozzles are shown spraying rinse fluid 66 at the rinse wheel. The nozzles thus define one or more rinse stations within the confines of the second tub. It is preferred to have a plurality of rinse stations including first, second and final rinse areas, a void area for draining and an air knife area for blowing air on the ends. These areas are shown in FIG. 2. The areas may be separated by ribs 58 so the catch basin can collect the rinse fluids for recycling. Appropriate plumbing is supplied for providing the desired rinse fluid to each rinse station.

The tank 12 is completed by a mounting plate 68 which fits over the top of the first tub. The mounting plate has a flange 70 engaging the inner wall 28 (FIG. 3) and an opening 72 for the e-wheel 14.

Turning now to the infeed mechanism 16, a rotary downstacker 74 is provided for each lane. In the illustrated embodiment there are three lanes, thus, three downstackers are used. The downstackers feed ends E onto a lug transfer belt 76 which revolves around pulleys 78. A suitable support frame and drive are provided. The lug transfer belt carries a plurality of magnets arranged in rows across the width of the belt. Each row has as many magnets as there are lanes. The downstackers place ends on the magnets which retain the ends as they are carried around the head pulley.

Although not shown herein, it will be understood that the infeed mechanism 16 includes a set of cams for deflecting the fingers of the e-wheel to accept the ends. There are also guides which wipe the ends off the lug belt and onto the deflected fingers. Shields may also be provided which reduce the effect of the field of the magnets near the point where the ends are to be removed from the lug belt. Once the ends are placed adjacent the fingers of the e-wheel, the cams release the fingers which hold the ends in spring-loaded, gripping relation. These cams and guides are essentially similar to those of the Kossman U.S. Pat. No. 4,908,153 patent, to which reference is made for the specific disclosure. One set of cams and guides is provided for each lane. The infeed mechanism may also include a wire brush shown schematically at 79 in FIG. 1 only. The brush cleans is effective to clean the fingers (described below) of the electrocoating wheel 14.

Looking next at the electrocoating wheel 14 in FIGS. 1 and 2, the e-wheel comprises two or more circular phenolic laminate plates 80 mounted on a shaft 82. The shaft is supported in bearings 84 which are mounted on a rectangular frame 86. The frame rests on mounting plate 68. A drive motor 88 (FIG. 2) drives shaft 82 to cause the e-wheel to rotate.

The peripheries of the plates 80 are joined by holder bars 90 each of which mounts a plurality of fingers 92. The fingers are thin, flexible, rectangular, metal strips, similar to a rule, which are cantilevered from the holder bars 90 in a radial direction relative to the e-wheel. As can be seen in FIGS. 1 and 2 the fingers are arranged with their width parallel to the direction of movement. Thus, the fingers are deflectable perpendicular to the direction of movement. That is, the fingers are deflectable by the cams in a direction parallel to the axis of the e-wheel. The fingers are arranged in pairs across the width of the e-wheel, one pair for each lane. While three lanes are shown, there could be more or less.

One fingers of each pair is electrically connected to a power supply through wires and a commutator attached to one of the plates 80. Although not shown here, these elements may be similar to the Kossman patent.

The transfer turret 18 and transfer elevator 20 will now be described. The elevator comprises a plurality of upright frame members 94, one for each lane. The frame members are mounted on the lip 44 of the outer tank wall 36. Each frame member has vertical flanges 95 at its edges. See FIGS. 2 and 4. Each frame member also has a pair of spaced ears 96 at the top and bottom thereof for mounting top and bottom sprockets 98, 99 on shafts 100, 101. A chain 102 revolves on the sprockets of each upright frame, carrying a plurality of magnets 104 (FIG. 1) for retaining the ends. Alternately, a chain having protruding pins or dogs could be substituted for the magnets, if, for example, aluminum ends are being coated. In this case the flanges 95 of the frame members would be turned over to form a hook. The opposing hooks and body of the frame would define a channel enclosing the ends as they traveled down the elevator.

A pair of arms 106, 107 are fastened to the outer upright frame members 94 and extend inwardly toward the e-wheel 14. The arms mount a shaft 108 on which the transfer turret 18 rotates. The turret may comprise a series of plates, one for each lane. Once again this accommodates variable numbers of lanes. Each plate carries magnets 110 for retaining the ends on the turret. Cams and guides (not shown but similar to those in the Kossman patent) are provided near the tangent point of the turret and e-wheel so that the cams will deflect the fingers, allowing the ends to be removed and guided onto the adjacent transfer turret magnets 110.

The transfer turret 18 and transfer elevator 20 are driven from shaft 82 through a drive train including sprocket 112 on shaft 82, belt or chain 114, and sprocket 115 on stubshaft 117. Stubshaft 117 is mounted in arm 106 and carries gear 116 in mesh with gear 118 on shaft 108. Shaft 117 also has a sprocket 119 which is connected to sprocket 122 on shaft 100 by belt or chain 120.

As seen in FIGS. 4 and 5, the lower end of the transfer elevator 20 includes guide tracks 124A–D. These tracks merge with the guide flanges 95 around a right angle turn. Ends carried down the elevator are held between the flanges 95 until they contact the guide tracks 124 in the corners. From there the ends are picked up by a pin on the rinse wheel 22 and translated in the direction of the arrow A in FIG. 4.

The rinse wheel 22 is best seen in FIGS. 3, 4 and 5. The rinse wheel includes a large, ring-shaped bearing including an inner race 126 bolted to mounting plate 68 and an outer race 128. The outer race is fastened to a ring gear 130 on its upper surface and has an extension 132 on its lower surface. The ring gear teeth mesh with those of a drive pinion 134 which is mounted on drive shaft 56. Depending from extension 132 is an annular carrier 136. The carrier has pockets 138 for receiving the ends. Associated with each pocket is a pin or dog (not shown) which picks up an end sitting at the junction of flanges 95 and guides 124 of the transfer elevator. The pins push the ends into the pockets 138 which then carry the ends out of the chutes defined by guides 124.

The carrier defines a rinse conveyor which transports ends through the rinse stations defined in the second tub. This conveyor is arranged in a curved manner to reduce the amount of floor space required by the apparatus It will be understood that while the rinse conveyor is described as being curved about a vertical axis, the word curved is used in the general sense. Thus, while the rinse conveyor shown is a circular wheel, the path described by the rinse conveyor could be otherwise. For example, the path could be a combination of straight or circular segments, with connecting corners or the like so long as, in total, the path surrounds or is surrounded by at least a portion of the electrocoating wheel. In other words, the rinse conveyor does not lie in a single vertical plane.

In addition to the small footprint just mentioned, another advantage of the present invention is the ability to have multiple lanes of ends and the ability to readily vary the number of lanes. Arranging the fingers radially as shown permits more than two lanes to be used.

Whereas a preferred form of the invention has been shown and described, it will be realized that modifications may be made thereto without departing from the scope of the following claims.

I claim:

1. An electrocoating apparatus for can ends, comprising:

a first tub containing a bath of electrocoating solution;

a second tub defining at least one rinse station, the rinse station including means for rinsing coated can ends;

an electrocoating wheel rotatable about a first axis and partially submersed in the electrocoating bath in the first tub, the wheel having holding means for releasably securing can ends to the wheel while carrying ends through said electrocoating bath;

a rinse wheel rotatable about a second axis substantially perpendicular to the first axis, the rinse wheel being disposed at least partially in said second tub, the rinse wheel having holding means for releasably securing can ends to the rinse wheel while carrying coated ends through said rinse station;

transfer means for removing coated ends from the electrocoating wheel and placing them on the rinse wheel; and drive means for driving the electrocoating wheel, rinse wheel and transfer means.

2. The apparatus of claim 1 wherein the first axis is horizontal and the second axis is vertical.

3. The apparatus of claim 2 wherein the center of the electrocoating wheel intersects the second axis.

4. The apparatus of claim 3 wherein the center of the electrocoating wheel is located above the rinse wheel.

5. The apparatus of claim 1 wherein the first tub has a first bottom wall and inner side walls joined to the first bottom wall to define a central enclosure and the second tub has outer walls at least partially surrounding the inner side walls and a second bottom wall connecting the outer walls to the inner side walls to define a ring-shaped catch basin.

6. The apparatus of claim 5 wherein the first tub includes a cover with an opening defined therein for receiving the electrocoating wheel.

7. The apparatus of claim 5 wherein the second tub further includes a splash guard covering at least a portion of the catch basin.

8. The apparatus of claim 1 further comprising:

an infeed means for placing uncoated work pieces on the holding means of the electrocoating wheel; and discharge means for removing rinsed work pieces from the rinse wheel.

9. The apparatus of claim 8 wherein the infeed means comprises a lug transfer belt which places uncoated ends on the holding means of the electrocoating wheel.

10. The apparatus of claim 1 wherein the transfer means includes a transfer turret mounted in tangential relation to the electrocoating wheel, the transfer turret having pockets for receiving coated ends.

11. The apparatus of claim 10 wherein the transfer means further comprises a transfer elevator means for carrying ends from the transfer turret to the rinse wheel.

12. The apparatus of claim 1 wherein the means for rinsing coated can ends at the rinse station comprises a plurality of nozzles spraying rinsing fluid on the ends.

13. The apparatus of claim 1 wherein the holding means of the electrocoating wheel comprises a plurality of pairs of spaced, flexible fingers each cantilevered in a radial direction beyond the circumference of the wheel to define a free end on each finger for engaging a can end.

14. The apparatus of claim 13 wherein each finger comprises a thin strip of metal, with the plane of the metal strip being parallel to the plane defined by the electrocoating wheel.

15. An apparatus for electrocoating work pieces, comprising:

a first tub containing a bath of electrocoating solution;

at least one second tub defining at least one rinse station, the rinse station including means for rinsing coated work pieces;

a first conveying means partially submersed in the electrocoating bath in the first tub, the first conveying means having holding means for releasably securing work pieces to said first conveying means while it carries work pieces through said electrocoating bath;

a second conveying means disposed at least partially in said second tub, the second conveying means having holding means for releasably securing work pieces to said second conveying means while carrying coated work pieces through said rinse station, the second conveying means being arranged so as to carry the work pieces along a path which is curved about a vertical axis;

transfer means for removing coated work pieces from the first conveying means and placing them on the second conveying means.

16. The apparatus of claim 15 wherein said path at least partially surrounds said first conveyor means.

17. The apparatus of claim 15 further comprising:

infeed means for placing uncoated work pieces on the holding means of the first conveying means; and discharge means for removing rinsed work pieces from the second conveying means.

18. The apparatus of claim 15 wherein the first conveying means comprises an electrocoating wheel rotatable about a horizontal axis.

19. The apparatus of claim 18 wherein the second conveying means comprises a rinse wheel rotatable about a vertical axis.

20. The apparatus of claim 19 wherein the center of the electrocoating wheel intersects the axis of the rinse wheel and is located above the rinse wheel.

21. In an electrocoating apparatus for can ends of the type having a first conveyor including holding means for releasably securing can ends to the conveyor, the conveyor being partially submersed in a bath of electrocoating solution, a second conveyor for receiving coated ends from the first conveyor and carrying them through a plurality of rinse stations which contain rinse solutions, the improvement comprising a tank for containing the electrocoating and rinse solutions, the tank comprising:

a first tub having a first bottom wall and inner side walls joined to the first bottom wall to define a central enclosure; and a second tub having outer walls at least partially surrounding the inner side walls and a second bottom wall connecting the outer walls to the inner side walls to define a ring-shaped catch basin.

22. The apparatus of claim 21 wherein the second tub further comprises a splash guard extending from the outer walls to the inner side walls.

23. The apparatus of claim 21 further comprising a plurality of nozzles mounted in the second tub and directed to spray rinse solution on the ends carried through the second tub by the second conveyor.

* * * * *